United States Patent [19]

Hrdina et al.

[11] 3,989,069

[45] Nov. 2, 1976

[54] METHOD OF AND APPARATUS FOR COMPENSATING FOR WEFT TENSION IN TRAVELING-WAVE SHEDDING LOOMS

[75] Inventors: Karel Hrdina; Jaroslav Dostal; Vaclav Borovec, all of Usti nad Orlici, Czechoslovakia

[73] Assignee: Vyzkumny Ustav Bavinarsky, Usti nad Orlici, Czechoslovakia

[22] Filed: July 18, 1975

[21] Appl. No.: 597,390

Related U.S. Application Data

[63] Continuation of Ser. No. 496,831, Aug. 12, 1974, abandoned.

[30] Foreign Application Priority Data

Oct. 24, 1973 Czechoslovakia ..... 7319-73

[52] U.S. Cl. ..... 139/436

[51] Int. Cl.[2] ..... D03D 47/35

[58] Field of Search ..... 139/12, 13, 116, 122 H, 139/435, 436, 450

[56] References Cited

UNITED STATES PATENTS

| | | | |
|---|---|---|---|
| 3,724,508 | 4/1973 | Jekl et al. | 139/12 |
| 3,732,896 | 5/1973 | Jekl et al. | 139/12 |
| 3,862,647 | 1/1975 | Holub et al. | 139/12 |
| 3,862,648 | 1/1975 | Langr et al. | 139/12 |

*Primary Examiner*—Henry S. Jaudon

[57] ABSTRACT

Method of and apparatus for compensating for weft tension in the region between a fabric selvedge and weft thread spooling units in traveling wave shedding looms wherein the spooling units follow an endless path of which one portion extends in common with another endless path followed by weft thread inserters containing a weft supply package, said weft tension compensation taking place after the respective weft thread spooling unit and the weft thread inserter have left each other and after the latter has entered a weaving shed as well as after the weft thread has been woven into the fabric fell, up to the instant at which the weft thread has been severed adjacent the fabric selvedge, the weft thread withdrawal from the spooling unit being blocked upstream the point of divergence of said respective paths of the weft thread spooling units and the weft thread inserters. In accordance with the invention, after the withdrawal of the weft thread from the spooling unit has been blocked, the path of the weft thread between said spooling unit and said inserter is extended to form a loop reserve produced by the weft supply package received in said inserter, such reserve being released again after the inserter has entered the shed and after the weft thread has been woven into the fabric fell, whereby the weft tension is compensated for by straightening the extended weft path in said region up to the instant at which the weft thread is severed.

5 Claims, 5 Drawing Figures

METHOD OF AND APPARATUS FOR COMPENSATING FOR WEFT TENSION IN TRAVELING-WAVE SHEDDING LOOMS

This is a continuation of application Ser. No. 496,831, filed Aug. 12, 1974, now abandoned.

The present invention relates to a method of compensating for weft tension in traveling-wave shedding looms, and more particularly in the region between the fabric selvedge and weft thread spooling units which follow an endless path of which one portion extends in common with another endless path followed by weft thread inserters containing a weft supply package. The weft tension compensation takes place after the respective weft thread spooling unit and the weft thread inserter have left each other and after the latter has entered a weaving shed and the weft thread has been woven into the fabric fell, up to the instant at which the weft thread has been severed adjacent the fabric selvedge, the weft thread withdrawal from the spooling unit being blocked upstream of the point of divergence of said respective paths of the weft thread spooling units and the weft thread inserters.

The apparatus for carrying out the afore-mentioned method comprises weft thread spooling units adapted to follow an endless path of which one portion extends in common with another endless path adapted to be followed by weft thread inserters; said weft spooling units are provided with a device for blocking the withdrawal of weft thread from said spooling unit upstream of the point of divergence of said two paths.

As is known, traveling-wave shedding looms operate a plurality of weft thread inserters which, in operation, follow a first endless path extending through the weaving region of the loom, in which region they insert metered weft thread lengths into successively opening sheds. After having left said weaving region, the weft thread inserters are returned to their weft loading positions at the opposite side of the fabric where they are refilled with fresh weft supply for the next weaving cycle.

Similarly, the weft thread spooling device comprises a plurality of weft thread spooling units which, in operation, follow another second endless path of which one portion extends in common with said first path of the weft thread inserters. Each spooling unit is equipped with a carrier from a weft supply package.

Each weft thread spooling unit is further provided with a blocking device adapted to block the weft withdrawal upstream of the point of divergence of the respective paths of the weft inserter and the weft spooling unit, so that after the two last-mentioned elements have left each other to follow its own respective path, the weft thread is withdrawn only from the supply wound on the supply package received in the weft inserter. Such an arrangement ensures an accurate length of weft thread to be wound onto the weft inserter bobbin.

The weft withdrawal blocking device is operated so that it blocks the withdrawal of the weft thread from the supply package of the weft inserter before the two aforementioned elements have left each other, and is disabled from operation before the weft thread has been rewound onto the bobbin of the inserter, which latter together with the weft spooling unit passes through the spooling region.

After having left the weft thread spooling unit, the weft inserter enters the open weaving shed adjacent a fabric selvedge at which the weft thread is secured by a leno weave.

When the weft inserter enters the weaving shed, the weft thread is introduced by a directing peg into a shearing mechanism, a clamping device, and a helical groove of a rotary reed. The weft clamping device ensures that a desired weft tension prevails adjacent the fabric selvedge. The weft thread is clamped and simultaneously severed by the shearing mechanism close to the fabric selvedge.

It is to be noted that the weft thread clamping and severing operations require precise synchronization and adjustment. If the weft thread is severed prematurely, it is disengaged from the clamping device and undesirably pulled further into the shed; on the other hand, in case of a delayed cut-off the weft thread becomes excessively tensioned between the fabric selvedge and the spooling unit, so that frequent breakages occur, particularly when processing yarns of low tenacity. The precise timing of the weft severing operation is especially important when the weft inserters move at high speed.

It is an object of the present invention to provide a method of compensating for a weft thread tension between the fabric and the spooling unit that is capable of ensuring a smooth weaving process without failures and without excessive claims on timing of the weft severing operation and on the synchronization thereof with the preceding and the next step, as well as to provide a simple, functionally reliable and space-saving apparatus for carrying out the method according to the invention.

In order to eliminate the disadvantages of the prior art as hereinabove set forth, there is provided a method of compensating for weft tension in traveling-wave shedding looms, and more particularly in the region between a fabric selvedge and weft thread spooling units following an endless path followed by weft thread inserters containing a weft supply package. The weft tension compensation takes place after the respective weft thread spooling unit and the weft thread inserter have left each other and after the latter has entered a weaving shed, as well as after the weft thread has been woven into the fabric fell, up to the instant at which the weft thread has been severed adjacent the fabric selvedge. The weft thread withdrawal from the spooling unit is blocked upstream of the point of divergence of said respective paths of the weft thread spooling units and the weft thread inserters.

In the method according to the invention after the withdrawal of the weft thread from the spooling unit has been blocked, the path of the weft thread between said spooling unit and said inserter is extended to form a loop reserve produced by the weft supply package received in said inserter, such reserve is released again after the inserter has entered the shed and after the weft thread has been woven into the fabric fell, whereby the weft tension is compensated for by straightening the extended weft path in said region up to the instant at which the weft thread is severed.

The invention includes an apparatus for carrying out the afore-described method. Such apparatus, which is adapted for use in traveling-wave shedding looms, comprises weft thread spooling units adapted to follow an endless path of which one portion extends in common with another endless path adapted to be followed by weft thread inserters, said weft spooling units being provided with a device for blocking the withdrawal of weft thread from said spooling unit upstream of the point of divergence of said two paths. In the apparatus, according to the invention, on each spooling unit there is journalled a weft tension compensating lever provided with a guiding arm having a weft guiding eyelet, and with a weft controlling arm in the path of which there is arranged a guide rail supported by a frame member of the spooling units, said guide rail having:

a. a wedge-shaped onrun for deflecting said guiding arm from its starting position in which a thread guide provided on the spooling unit is spaced the shortest distance from said weft guiding eyelet into an extreme position in which the thread guide is spaced the greatest distance from the weft guiding eyelet, during which deflecting movement a weft reserve in a loop form is produced by unwinding a weft length from a weft supply package received in the weft thread inserter, b. a curved portion for maintaining the guiding arm in said extreme position, and c. a wedge-shaped offrun adapted to return the guiding arm into said starting position whie the weft reserve is released during said return, whereby after the inserter has entered the shed and the weft thread has been woven into the fabric fell, the extended weft path between the inserter and the fabric selvedge becomes straightened.

In an alternative embodiment of the apparatus of the present invention, between the endless path of the spooling units and the fabric selvedge there is arranged a deflecting finger adapted to reciprocate between (a) an operative position in which it interferes in the path of the weft thread downstream of the point in which the inserter and the spooling unit leave each other, whereby by extending the weft path a weft reserve is produced by the weft supply package in the inserter, and (b) an inoperative position in which said reserve is released by said deflecting finger. The change of the position of the deflecting finger when displaced from said operative position (a) into said inoperative position (b) in which latter the weft reserve is released for straightening the extended weft path between the spooling unit and the fabric after the inserter has entered the shed and after the weft thread has been woven into the fabric fell.

The path of the deflecting finger can extend either in a substantially horizontal or in a substantially vertical direction.

For example, the deflecting finger can be provided on a shiftable pull rod coupled via a pin/link transmission with a rockable arm of which movement is derived from a cam.

The weft cut-off from the spooling unit is effected with the weft held under a desired tension, which prevents fiber dust from rising in the region of the shearing mechanism and which makes the thread cut smooth and frayless.

In order that the invention shall be better understood, some preferred embodiments thereof are described hereinafter with reference to the accompanying schematic drawings in which.

Figure 3:
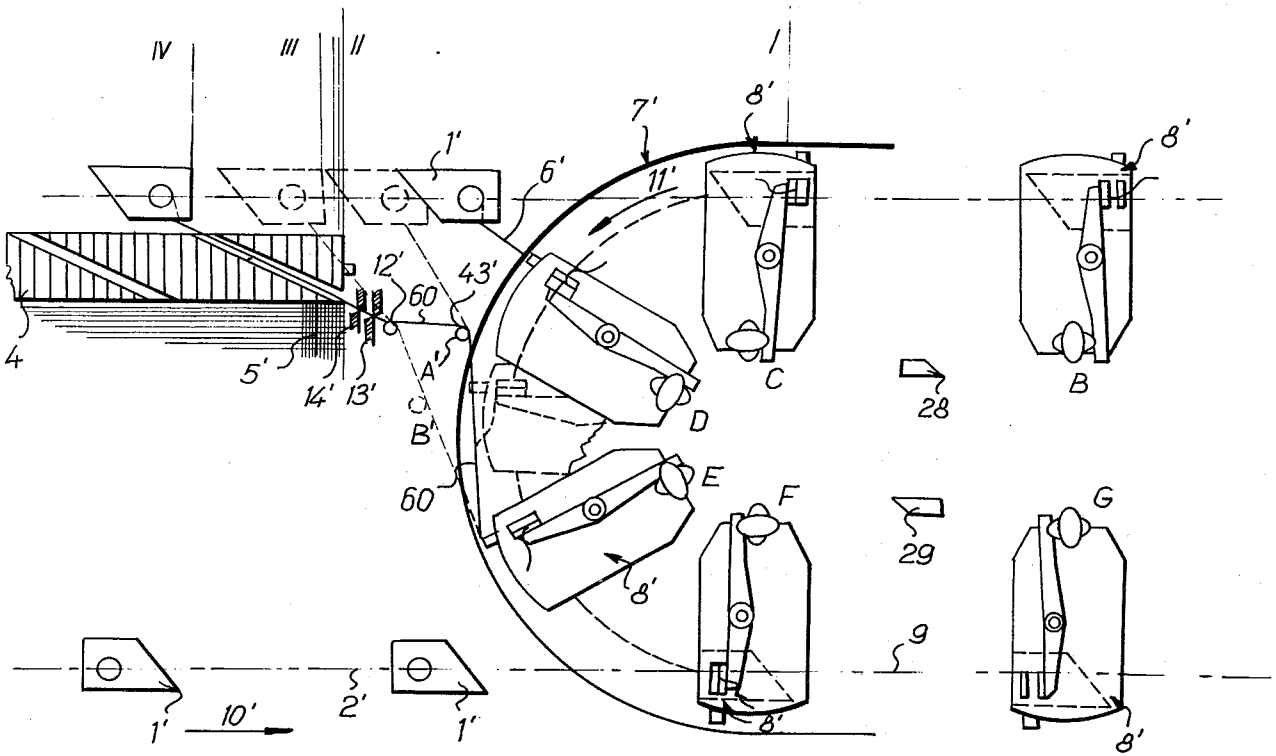
FIG. 3 is a top view of a second, alternative embodiment of weft thread tension compensating mechanism in accordance with the invention.
Figure 4:
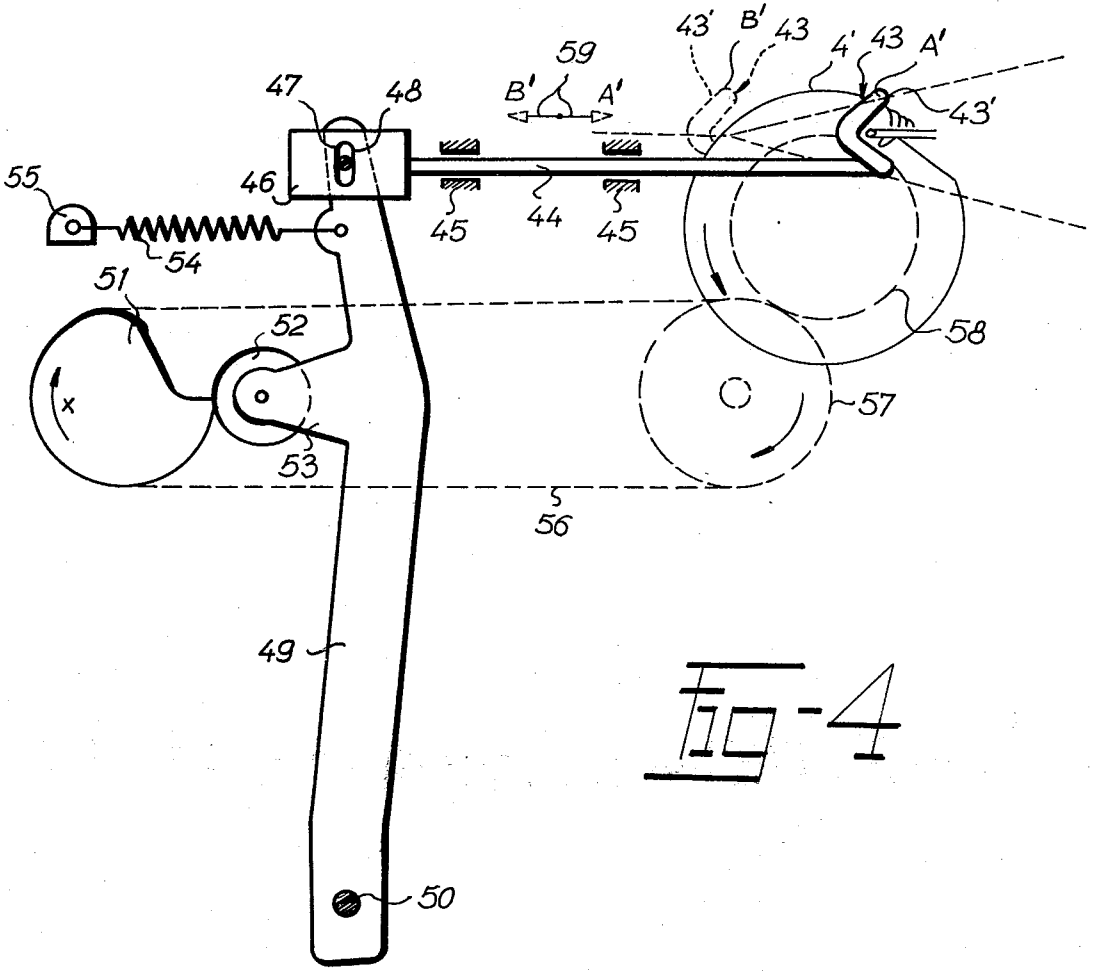
Figure 5:
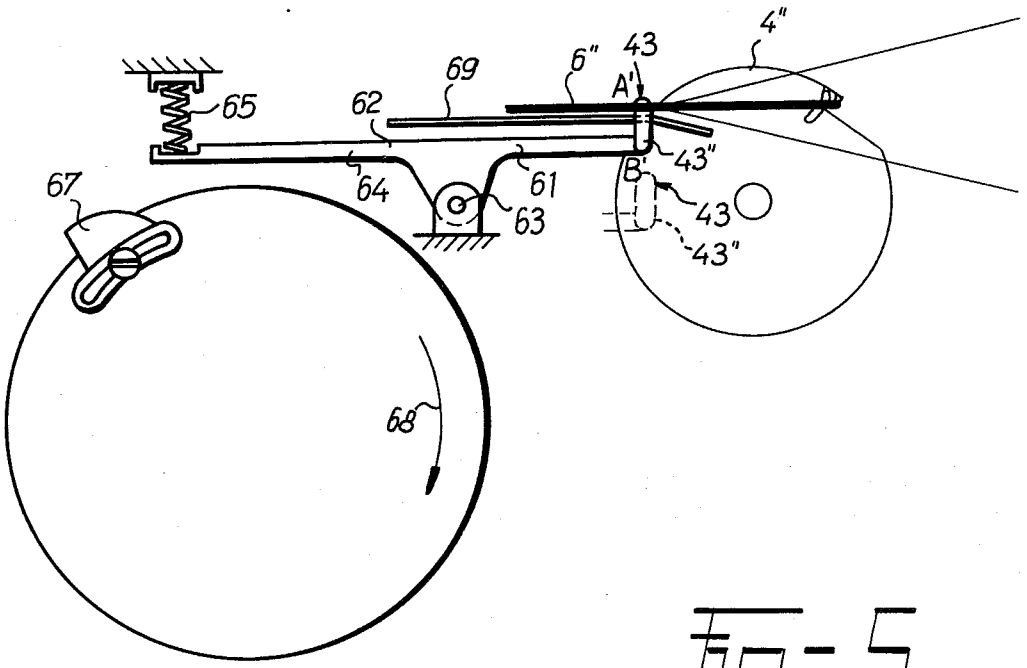

FIG. 4 is a front view of driving means for driving the weft thread tension compensating mechanism illustrated in FIG. 3, wherein a weft deflecting finger is adpated to reciprocate in a horizontal path; and FIG. 5 is a front view of driving means for driving a second, alternative weft thread tension compensating mechanism, wherein the weft deflecting finger is adapted to reciprocate in a horizontal path; and As noted above, FIG. 1 shows an existing embodiment of the weft thread spooling device in a known traveling-wave shedding loom, and also illustrates a part of the weaving region of the machine.

As it can be seen, such loom has a plurality of weft thread inserters 1 which in operation follow a partly shown endless path 2 extending through a weaving region 3 which includes a schematically illustrated rotary reed 4 and a fabric 5 being formed while in said weaving region 3. The weft thread inserters 1 successively insert metered lengths of weft thread 6 into successively opening or traveling-wave sheds. After having passed the weaving region, the weft thread inserters are returned to their starting position adjacent the opposite fabric selvedge where they are refilled with fresh weft supply in a spooling device 7 to perform the next weaving cycle.

The spooling device 7 situated, by way of example, at the righthand selvedge (FIG. 1) of the fabric 5 to be formed, comprises partly shown weft thread spooling units 8 which in operation follow a partly shown endless path 9. Each weft thread spooling unit 8 is provided with a carrier for weft thread supply packages (not shown) and with a weft spooling mechanism (not shown).

The operation of spooling weft thread onto bobbins of the weft thread inserters 1 takes place in that part of the endless path 9 of the spooling units 8 which extends in common with the respective part of the endless path 2 of the weft thread inserters 1.

It is to be understood that the linear speeds of the respective weft thread inserters 1 and of the weft spooling units 8, when advancing along said common or spooling path portion, are identical. After the paths 2 and 9, respectively, of the weft thread inserter 1 and the weft spooling unit 8 have diverged and each has assumed its own course, the weft thread inserter 1 is conveyed in a straight direction toward the weaving region 3. The direction of the movement of the weft thread inserter 1 is indicated by arrow 10 and that of the spooling units 8 by arrow 11.

Between the spooling device 7 and the rotary reed 4 there are arranged a weft thread directing peg 12, a shearing mechanism 13 and a weft thread clamping device 14.

The weft thread directing peg 12 introduces the weft thread 6 into the shearing mechanism 14 and into a helical groove of the rotary reed 4. The weft thread clamping device 14 ensures a desired tension of the weft thread 6 to be woven into the fabric fell. Means designed to actuate the afore-described elements, the weft thread spooling units, the rotary reed and the weft thread inserters are neither described nor shown in detail, since the mechanisms are well-known. Such mechanisms have been described and illustrated, for example in the U.S. patent application Ser. No. 366,403 to HOLUB, filed June 24, 1973, now U.S. Pat.

No. 3,862,647 (corresponding to Czechoslovak patent application No. PV 4053-72), and U.S. patent application Ser. No. 3,65,998 to ZABROVSKY, filed June 4, 1973, now U.S. Pat. No. 3,848,641 (corresponding to Czechoslovak patent application No. PV 4057-72), and Czechoslovak patents Nos. 149,999, 148,157.

Each weft thread spooling unit 8 is provided with a gripping device for blocking the withdrawal of weft thread from the spooling unit 8 before the later has left the weft thread inserter 1. The blocking device is in the form of a two-armed gripping lever 16 journalled about a pivot 17 secured to a plate 18 provided on the spooling unit 8. The gripping lever 16 is a first-class lever, and has two arms 19 and 26 of different lengths. The shorter arm 19 is provided with a jaw 20 which is forced, by a spring 22 bearing upon said shorter arm 19 of the lever 16, toward a stationary jaw 23 provided on said plate 18. The path of the weft thread 6 between the spooling unit 8 and the weft inserter 1 extends between said jaws 20 and 23. The gripping of the weft thread 6 when withdrawn from the spooling unit 8, begins upstream of the point of divergence of the two said paths 2 and 9, respectively, of the weft inserter 1 and the spooling unit 8, and ends after said paths have met again; more particularly, such paths meet again before the take-up of the weft thread withdrawn from the spooling unit 8, onto the bobbin of the weft inserter 1 has taken place.

To this purpose, there is arranged on the plate 18 of the spooling unit 8 a rotary double cam 24 of which one part 25 controls the movement of the longer arm 26 of the gripping lever 16, whereas the other part 27 thereof interferes with the path of two stops 28 and 29 provided on a frame member (not shown) of the weft thread spooling device 7. The stop 28 determines the beginning while the stop 29 determines the end of the blocking of the weft thread withdrawal from the spooling unit 8. The particular positions of the spooling units 8 along the shown part of their endless path 9 are indicated by characters A through H, inclusive.

As hereinabove set forth in operation the weft thread inserters 1 follow the endless path 2 in a traveling-wave shedding loom, and insert, in the weaving region 3 of the machine, metered weft thread lengths into the successively opening sheds. After having left the weaving region 3, the weft inserters 1 return to the opposite side of the fabric 5 where they are refilled in the spooling device 7 with the fresh weft 6 to be woven in during the next weaving cycle.

Upstream of the point of divergence of the two paths 2 and 9, the weft thread inserters 1 are already filled with the desired length of weft thread, the jaws 20 and 23 being opened at this instant. In the positions A, B and C there are shown spooling units 8 with filled weft inserters 1.

Upstream of the point of divergence of the two paths 2 and 9, the cam part 27 of the spooling unit 8 abuts the stop 28 so that the other cam part 25 releases the longer arm 26 of the blocking lever 16 and the weft thread becomes clamped between the jaws 20 and 23.

During the next movement of the weft thread inserter 1 the weft withdrawal from the inserter is begun, the weft thread 6 being unwound from the inserter 1, the weft being tensioned due to a braking action of a brake (not shown) provided in said inserter 1.

The spooling units 8 together with unblocked weft thread are shown in positions A and B, those with blocked weft thread are shown in positions C, D, E and F, and the spooling units 8 again with unblocked weft thread and shown in positions G and H.

As soon as the weft inserter 1 has entered the weaving shed, the weft directing peg 12 introduces the weft thread into the shearing mechanism 13, into the weft thread clamping device 14, and into the helical groove 15 of the rotary reed 4. As the spooling unit 8 proceeds to be conveyed, the weft thread 6 is simultaneously tensioned between the weft inserter 1 and the spooling unit 8. At the same time that the weft thread 6 is clamped by the clamping device 14, the shearing mechanism 13 severs the weft thread 6 close to the selvedge of the fabric 5. At the instant of the blocking of weft withdrawal, and after the weft thread 6 has been severed, the spooling unit 8 is in position F. In this position the spooling unit 8 again meets the respective empty weft thread inserter 1.

As the spooling unit 8 proceeds in its forward movement, the cam part 27 abuts the stop 29 whereby the gripping lever 16 is caused to return to its starting position while its jaw 20 releases the weft thread 6, and within the spooling region of the endless path 9 a weft supply for the next weaving cycle is wound onto the bobbin of the inserter 1 in a well-known manner.

Figure 1:
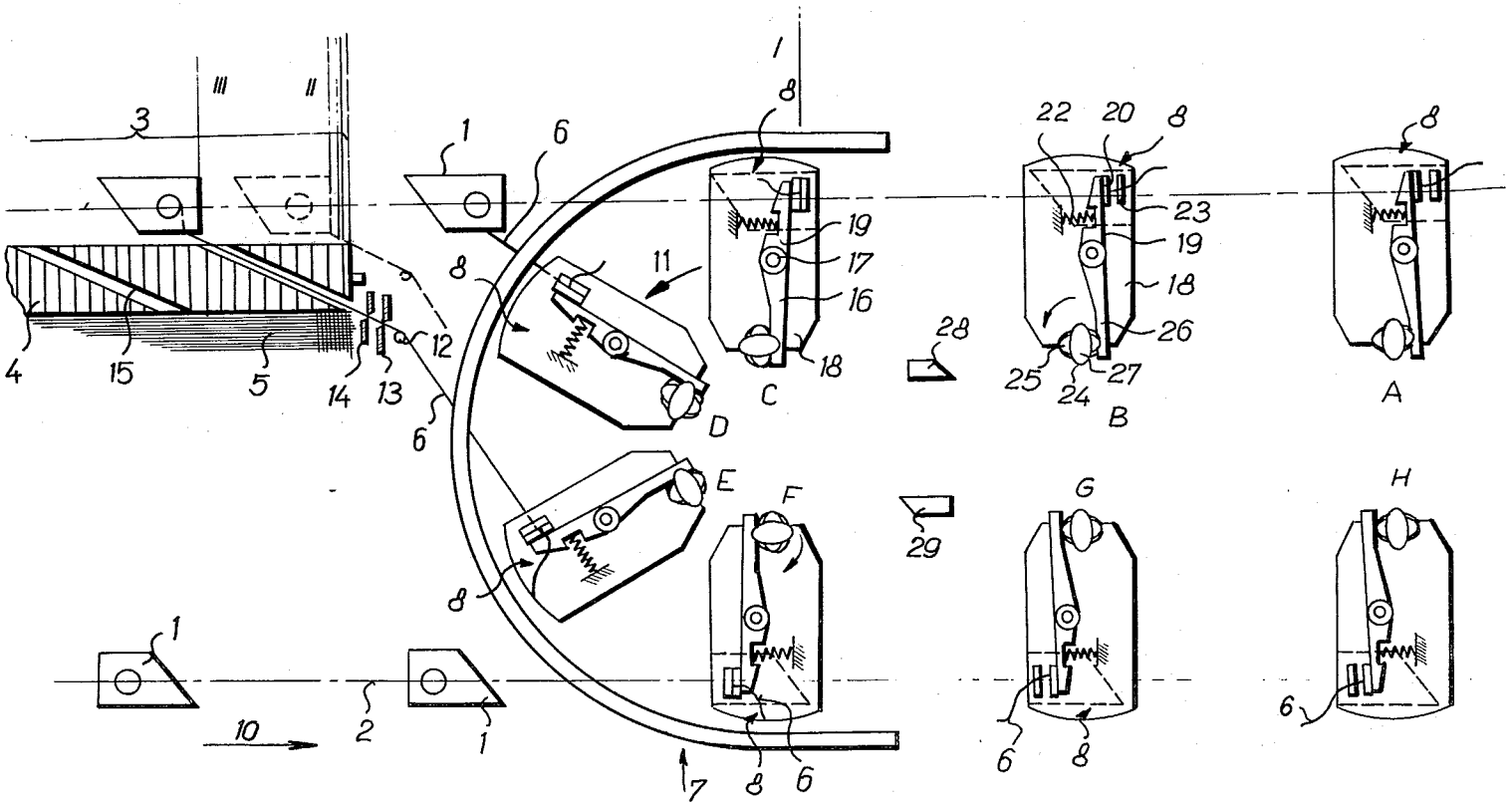
FIG. 1 PRIOR ART
FIG. 1 is a fragmentary schematic top view of a well-known prior art weft thread spooling device together with a part of the weaving region.

In the apparatus shown in FIG. 1, the position of the weft thread inserter 1 during the blocking of the weft thread withdrawal from the spooling unit 8, is indicated by the reference numeral I. The position of the weft inserter 1 when entering the shed, and the point where the weft thread 6 being withdrawn is crossed by warp threads and where the tension of said weft thread rises, is indicated by reference numeral II. Finally, the position of the weft inserter 1 at the instant of weft cutting off is indicated by the reference numeral III.

The apparatus for compensating for weft tension in traveling-wave shedding looms according to the invention will now be described with reference to FIGS. 2–5, inclusive. For the sake of clarity, in FIG. 2, which illustrates a basic loom substantially corresponding to FIG. 1, the devices for gripping the weft withdrawal on the spooling units 8 have been omitted.

About a pivot 30 provided in the top plate 18 of each spooling unit, there is journalled a compensating two-armed lever 31 comprising a longer guiding arm 32 terminating in a thread guiding eyelet 33, and a shorter curved thread-controlling arm 34 adapted to be engaged by a guide rail 35 secured, for example, by means of screws (not shown) to a frame member 36 of the spooling device 7. At the upstream end of said guide rail 35, relative to the direction of spooling unit advance, there is provided a wedge-shaped onrun 37, and at its downstream end thereof there is provided a similar off-run 38. Between said onrun 37 and offrun 38 there is provided a curved portion 39 the center of curvature of which is identical with that of the return curve of the endless path 9.

The overall length of said guide rail 35 is selected so as to begin upstream of the point in which the respective spooling unit 8 and the weft thread inserter 1 leave each other, but downstream of the stop 28, which means that it ends in the position E of the spooling unit 8.

During the operative engagement of the weft thread inserter 1 and the spooling unit 8, the weft thread 6 passes through a thread guide 40 formed by an aperture in the plate 18, further passes through the weft thread quiding eyelet 33 of the longer arm 32, and emerges at last from said thread guide 40.

If the longer arm 32 of the compensating lever 31 is out of engagement with the guide rail 35, the compensating lever 31 is in its starting position as indicated at A, B, C. In this position of the compensating lever 31, there exists the minimum distance between the weft thread guiding eyelet 33 and the thread guide 40, within which distance the weft thread guiding eyelet 33 when viewed from the top, is in register with the thread guide 40. Said starting position of the compensating lever 31 is ensured by the actual weft tension.

The apparatus shown in FIG. 2 operates as follows:

Before the weft thread inserter 1 and the spooling unit 8 have left each other the thread controlling arm 34 is engaged by the wedge-shaped onrun 37, whereby it is deflected in the direction of arrow 41 from its starting position into the extreme position, wherein the thread guiding eyelet 33 is spaced apart from the thread guide 40 at the maximum distance, whereby a weft thread reserve 42 in loop form is produced. After the weft thread inserter 1 and the spooling unit 8 have left each other, the weft thread 6 is withdrawn from the supply package received in the inserter 1.

After the weft thread inserter 1 has entered the weaving shed and the weft has been woven into the fell of the fabric 5, the tension of the weft thread 6 between the fabric 5 and the moving inserter 1 is compensated for by releasing the weft reserve 42, whereby the increment of length between the spooling unit 8 and the fabric 5 is also compensated for, until the weft 6 is severed by the shearing mechanism 13. The weft thread reserve 42 is released, due to the engagement of the controlling arm 34 with the wedge-shaped offrun 38, said release period corresponding to the interval of the movement of the controlling arm 34 along the wedge-shaped offrun 38. The weft thread 6 is severed by the shearing mechanism 13 adjacent the fabric 5 before the controlling arm 34 has left the wedge-shaped offrun 38, whereby it is possible to adjust the shearing interval within predetermined time limits.

The tension of the weft thread 6 during the release of the weft reserve 42 corresponds approximately to the tension to which the thread is exposed during the operation of weft spooling onto the bobbin of the inserter 1.

Alternative embodiments of the apparatus according to the invention for carrying out the method of the invention are schematically illustrated in FIGS. 3, 4 and 5.

Figure 2:
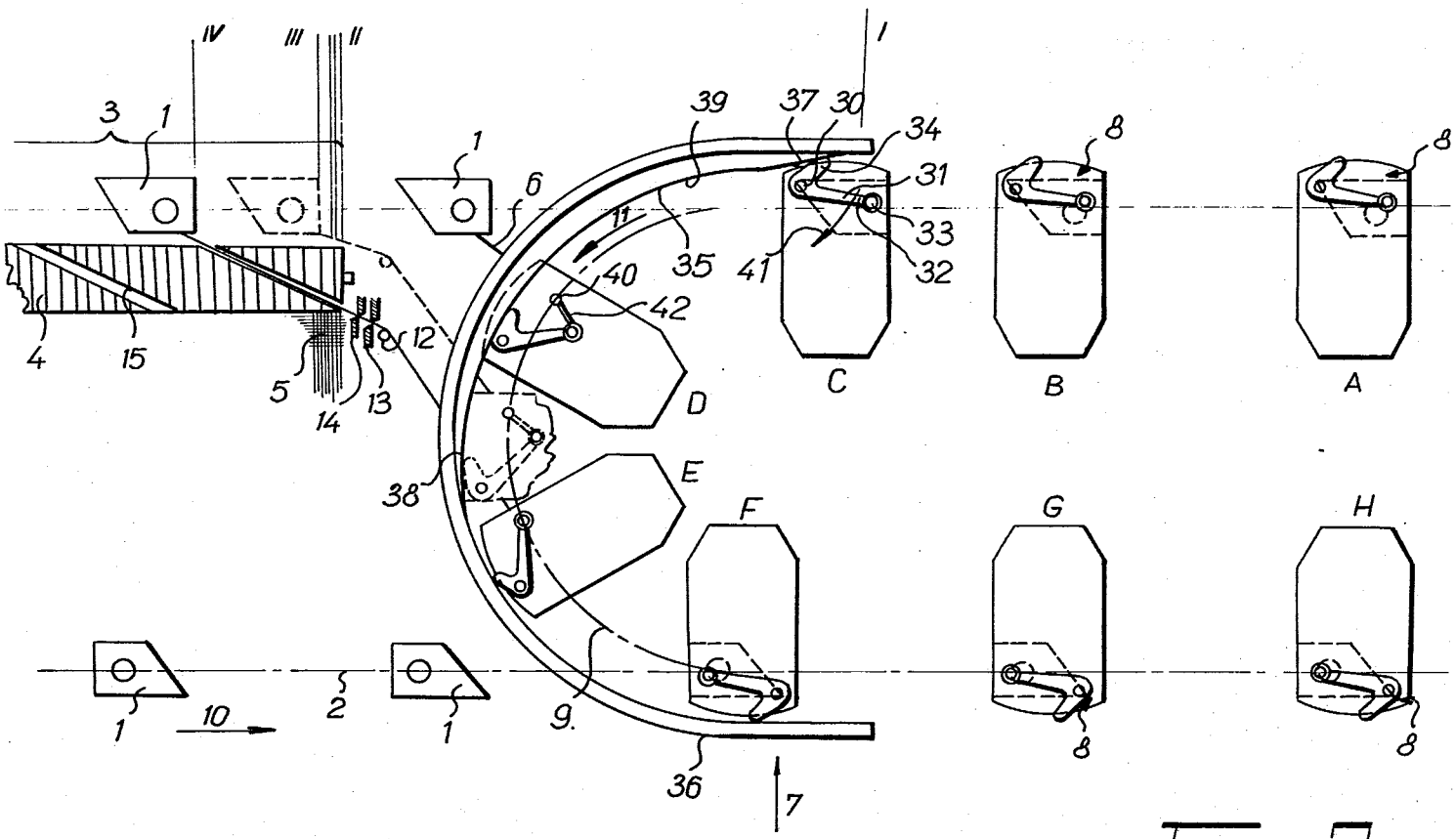
FIG. 2 is a top view of a similar spooling device equipped with a first illustrative embodiment of weft thread tension compensating mechanism in accordance with the invention.

In FIGS. 3 and 4 parts which are similar to those in FIG. 2 are designated by the same reference characters with an added prime, and in FIG. 5 such parts are designated by the same reference characters with an added double prime.

In contradistinction to the embodiment shown in FIG. 2, the weft thread spooling device 7' of FIG. 3 comprises only a single weft tension compensating device.

In this embodiment, there is arranged between the spooling device 7' and the fell of fabric 5' a weft deflecting finger 43 provided at the extremity of a substantially horizontal pull rod 44 which is guided in bearings 45 supported by a frame member (not shown). The weft deflecting finger 43 is formed with a hook 43'. The opposite end portion of the pull rod 44 carries a block 46 having an elongate slot 47 receiving a pin 48 provided on an arm 49 which is journalled about a stationary pivot 50. The swinging movement of said arm 49 is derived from a cam 51 adapted to engage a follower 52 rotatable on a lug 53 of said arm 49. The follower 52 is forced to follow the cam 51 by a coil tension spring 54 acting between said arm 49 and a frame member 55.

The cam 51 is driven via a transmission chain 56 and gears 57, 58 from the rotary reed 4. In operation, the pull rod 44 reciprocates betwen its operative position A' and its inoperative position B' as indicated by the double-headed arrow 59.

In said operative position A', the hook 43' interferes with the path of weft 6' between the inserter 1' and the spooling unit 8' so that the weft thread becomes bent over the hook 43' (FIG. 3), whereby the weft path is extended and a weft thread reserve 60 is thus produced. In the inoperative position, the hook 43' is located nearer the fabric 5' so that the weft reserve 60 is released.

The apparatus as shown in FIG. 3 operates as follows:

After the desired weft thread length has been wound on the bobbin of the inserter 1', the latter leaves the respective spooling unit 8', the withdrawal of weft 6' from said spooling unit 8' being blocked simultaneously. During the movement of the weft thread inserter 1' and the spooling unit 8', the weft thread 6' spanned under tension therebetween and withdrawn from the inserter 1', becomes bent over the hook 43' of the deflecting finger 43 which is now disposed in the operative position A'. In this way, as the two elements 1' and 8' proceed in their movement, the weft thread reserve is produced. After the weft thread inserter 1' has entered the weaving shed and the weft thread has been woven into the fell of the fabric 5', the deflecting finger 43 is displaced into its inoperative position B' while releasing the weft reserve which compensates for the tension of weft 6' by compensating for the weft length increment on the way between the spooling unit 8' and the selvedge of fabric 5'. Within the interval of releasing the weft reserve 60, the weft thread is severed by the shearing mechanism 13'.

With the embodiment according to FIGS. 2 and 3, in contradistinction to the apparatus illustrated in FIG. 1, the release of the weft thread reserve 42 and 60, respectively, withdrawn from the weft inserter, begins after the weft inserter has entered the weaving shed so that the weft reserve, up to the instant of cut-off, will replace the weft thread which would have to have been withdrawn directly from the inserter.

In order that the time sequence of the individual weft thread inserter positions shown in FIGS. 2 and 3 may be better understood, these will be hereinafter briefly explained as follows:

| | |
|---|---|
| at position I | the withdrawal of the weft thread 6 from the spooling unit 8 is blocked; |
| at position II | the weft thread inserter 1 enters the weaving shed and the withdrawn weft thread 6 is crossed by warp threads while its tension increases; |
| at position III | the release of the weft reserve 42 and 60, respectively, begins; and |
| at position IV | the weft thread 6 is severed by the shearing mechanism 13. |

In the embodiment shown in FIGS. 3 and 4, the path followed by the deflecting finger 43 is horizontal. According to another embodiment, shown in FIG. 5, the deflecting finger 43' is displaced in the vertical direction. Thus, for instance, the deflecting finger 43' is formed with a peg 43'' provided at the extremity of an arm 61 of a two-arm lever 62 which latter is journalled about a pivot 63 supported by the machine frame. The second arm 64 of the lever 62 is formed by a spring 65 against a cam 66 having an adjustable tooth 67 and adapted to rotate in the direction of the arrow 68, said cam 66 being driven by non-illustrated driving means.

During the rotation of the cam 66, the peg 43'' periodically reciprocates between the operative position A' and the inoperative position B' (FIGS. 3 and 5). In accordance with the path of the peg 43'', there is provided a stationary support 69 designed to prevent the weft thread 6 from being engaged or lowered by the peg 43'' when the latter is displaced from aid operative position A' to said inoperative position B'.

The apparatus shown in FIG. 5 operates as follows:

The weft thread reserve 60 is produced in the same manner as described with reference to FIG. 4, which means by bending the weft thread 6'' over the peg 43''. The weft thread reserve 60 produced is released by displacing the peg 43'' from said operative position A' to the inoperative position B'.

The frequency of stroke of the deflecting finger 43 is identical with the frequency at which the weft thread inserters 1 enter the weaving shed. The respective lifts of the cams 51 and 66 are selected in such a way that the deflecting finger 43 be in the operative position A' approximately at the instant at which the inserter 1'' and the spooling unit 8'' leave each other, and may be displaced to the inoperative position B', after the inserter 1'' has entered the weaving shed and the weft thread 6'' has been woven into the fell of fabric 5''.

The reciprocation of the deflecting finger 43' between said opertive and inoperative positions can also be derived from other mechanisms suitable to the purpose. The path to be followed by said deflecting finger can be even made inclined or curvilinear.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A method of compensating for weft tension in the region between a fabric selvedge and weft thread spooling units in a traveling-wave shedding loom wherein the weft spooling units follow an endless path of which one portion extends in common with another endless path followed by weft thread inserters containing a weft supply package, said weft tension compensation taking place after the respective weft thread spooling unit and the weft thread inserter have left each other and after the latter has entered a weaving shed as well as after the weft thread has been woven into the fabric fell, up to the instant at which the weft thread has been severed adjacent the fabric selvedge, the weft thread withdrawal from the spooling unit being blocked upstream of the point of divergence of said respective paths of the weft thread spooling units and the weft thread inserters, said method comprising extending the path of the weft thread between said spooling unit and said inserter, after said withdrawal of the weft thread from the spooling unit has been blocked, by forming a loop reserve from the weft supply package received in said inserter, and releasing said reserve after the inserter has entered the shed and after a portion of the weft thread has been woven into the fabric fell, whereby the weft tension is compensated for by straightening the extended weft path in said region up to the instant at which the weft thread is severed.

2. Apparatus for compensating for weft tension in the region between a fabric selvedge and weft thread spooling units in a traveling-wave shedding loom wherein the weft spooling units follow an endless path of which one portion extends in common with another endless path followed by weft thread inserters containing a weft supply package, said weft spooling units being provided with a device for blocking the withdrawal of weft thread from said spooling unit upstream of the point of divergence of said two paths, said apparatus comprising a weft tension compensating lever journalled on each spooling unit, said lever being provided with a guiding arm having a weft guiding eyelet, and with a weft controlling arm in the path of which there is arranged a guide rail supported by a frame member of the spooling units said guide rail having a wedge-shaped onrun for deflecting said guiding arm from its starting position in which a thread guide provided on the spooling unit is spaced the shortest distance from said weft guiding eyelet, into an extreme position in which the thread guide is spaced the greatest distance from the weft guiding eyelet, means for forming during such deflecting movement a weft reserve in a loop by unwinding a weft length from a weft supply package received in the weft thread inserter said guide rail having a curved portion for maintaining the guiding arm in said extreme position, and said guide rail having a wedge-shaped offrun adapted to return the guiding arm into said starting position while during said return the weft reserve is being released, whereby after the inserter has entered the shed and a portion of the weft thread has been woven into the fabric fell, the extended weft path between the inserted and the fabric selvedge becomes straightened.

3. In an apparatus for compensating for weft tension in the region between a fabric selvedge and weft thread spooling units in a travelling-wave shedding loom wherein the weft spooling units follow an endless path of which one portion extends in common with another endless path followed by weft thread inserters containing a weft supply package, braking means associated with said weft spooling units and operable for blocking the withdrawal of weft thread from said spooling unit upstream of the point of divergence of said two paths, and means for directing the withdrawn weft thread under tension toward the rotary reed, the improvement wherein the apparatus further comprises deflecting means including a finer disposed between the endless path of the spooling unit and the fabric selvedge upstream of the directing means, said finger being adapted to reciprocate between an operative position in which it interferes in the path of the weft thread downstream of the point at which the inserter and the spooling unit leave each other, whereby by extending the weft path a weft reserve is produced between the directing and the deflecting means, and an inoperative position in which said reserve is released by said deflecting finger and said directing means for straightening the extended weft path between the spooling unit and the fabric, the change of the position of the deflecting finger from said operative position into said inoperative one taking place after the inserter has entered the shed and after the weft thread has been woven into the fabric fell, and means for reciprocating the finger between the operative and the inoperative positions.

4. An apparatus as claimed in claim 3, wherein the endless paths of the spooling units and the weft thread inserters lie horizontal, and wherein the reciprocating means comprises means for oscillating the finger in substantially a horizontal direction.

5. An apparatus as claimed in claim 3, wherein the endless paths of the spooling units and the weft thread inserters lie horizontal, and wherein the reciprocating means comprises means for oscillating the finger in substantially a vertical direction.

* * * * *